US005709312A

United States Patent [19]

Lake

[11] Patent Number: 5,709,312

[45] Date of Patent: Jan. 20, 1998

[54] DISPOSABLE COVER FOR TRASH CONTAINERS

[76] Inventor: Robert D. Lake, 6918 Saint Ives Blvd., Hudson, Ohio 44236

[21] Appl. No.: 607,274

[22] Filed: Feb. 21, 1996

[51] Int. Cl.[6] ..... B65D 41/01

[52] U.S. Cl. ..... 220/287; 220/359; 215/319; 229/125.35; 229/125.37

[58] Field of Search ..... 215/232, 319, 215/326; 220/359, 287; 229/125.35, 136, 125.17, 125.37, 125.38; 150/154

[56] References Cited

U.S. PATENT DOCUMENTS

| | | | |
|---|---|---|---|
| 637,136 | 11/1899 | Lemmermann . | |
| 1,062,532 | 5/1913 | Blair . | |
| 1,368,864 | 2/1921 | Turner . | |
| 1,595,614 | 8/1926 | Pease | 215/232 X |
| 1,732,952 | 10/1929 | Stengel | 215/232 X |
| 1,743,280 | 1/1930 | Manson | 215/326 |
| 2,064,411 | 12/1936 | Brandstein . | |
| 2,173,686 | 9/1939 | Hamje | 150/154 X |
| 2,176,317 | 10/1939 | Wilcox | 215/326 |
| 2,305,494 | 12/1942 | Price | 215/326 |
| 2,396,225 | 3/1946 | Allen | 215/232 X |
| 2,420,916 | 5/1947 | Sorge . | |
| 2,432,662 | 12/1947 | Gardner . | |
| 2,467,503 | 4/1949 | Scriven . | |
| 2,500,549 | 3/1950 | Ketay et al. | 215/232 X |
| 2,715,928 | 8/1955 | Coy et al. . | |
| 3,138,801 | 6/1964 | Brodsky . | |
| 3,168,209 | 2/1965 | Brookins et al. . | |
| 3,306,521 | 2/1967 | Giacovas | 229/136 |
| 3,376,995 | 4/1968 | Hunt . | |
| 3,495,758 | 2/1970 | Wienecke, Jr. | 229/125.35 |
| 3,568,917 | 3/1971 | Vergobbi | 229/125.37 X |
| 3,876,133 | 4/1975 | Smith | 220/359 X |
| 4,246,945 | 1/1981 | Sterling . | |
| 4,295,508 | 10/1981 | Metzger . | |
| 4,573,632 | 3/1986 | Scheeren | 220/359 |
| 4,962,849 | 10/1990 | Anderson | 229/125.35 X |
| 5,002,220 | 3/1991 | Safranski | 229/136 X |
| 5,052,578 | 10/1991 | Goodwin | 229/125.17 X |

FOREIGN PATENT DOCUMENTS

| | | | |
|---|---|---|---|
| 2579439 | 10/1986 | France | 150/154 |
| 3935548 | 5/1991 | Germany | 220/359 |
| 2147564 | 5/1985 | United Kingdom | 220/359 |

*Primary Examiner*—Allan N. Shoap
*Assistant Examiner*—Nathan Newhouse
*Attorney, Agent, or Firm*—Hudak & Shunk Co. L.P.A.

[57] ABSTRACT

The invention relates to an adjustable, flexible cover for a container such as a trash or garbage receptacle comprising a flexible film which is impervious to water and odors and has a central portion bounded by a peripheral edge to cover the top opening of the trash receptacle whereas the peripheral edge contacts the sidewall or walls of the receptacle. The cover further has an adhesive sealing member which gathers the peripheral edge of the film to seal the top opening against the intrusion of precipitation and the leakage of odors. Optionally, the top surface of the central portion may include indicia such as holiday or sports designs. An alternative embodiment relates to a flexible bag having an adhesive sealing member on the peripheral edge thereof for application of the bag edge to the external side of the container.

8 Claims, 2 Drawing Sheets

DISPOSABLE COVER FOR TRASH CONTAINERS

FIELD OF THE INVENTION

The invention relates generally to an adjustable, disposable cover for a trash container and more specifically to an inexpensive, flexible cover which can be used to seal the contents of a variety of shapes and sizes of trash receptacles. Alternatively, the invention relates to a flexible bag which through an adhesive sealing member can be readily attached to a trash container.

BACKGROUND OF THE INVENTION

Traditional hard lids for trash containers can fall off or become lost when the containers are tipped over by scavenging animals or by vandals. Conventional covers also emit foul odors or leak when they become warped and dented during use. With respect to trash bags used in association with a trash container, the bags are often pushed and/or pulled to the inside of the container when trash is added thereto.

SUMMARY OF THE INVENTION

The invention relates to an inexpensive, disposable cover for a trash container. The cover can protect the contents of the trash container from wind, precipitation, and animal intrusion while awaiting curb-side collection. The cover further controls odors while being stored inside or near the house.

The present invention can be used in conjunction with the hard covers generally supplied with trash containers so as to provide an additional seal for the containment of odors. Alternatively, the disposable cover can function alone as an inexpensive replacement for lids which have been lost or damaged, or to prevent the loss of the lid by eliminating the need to attach the hard lid to the containers.

It is thus an object of the invention to provide an inexpensive trash container lid which can serve as an auxiliary seal in order to prevent animal scavengers from disturbing the contents of the container as well as to inhibit the escape of objectionable odors.

A further object of the invention is to provide a cover which can be used, instead of a conventional lid, with a trash container or for trash containers such as recycling bins which may not have a cover.

An additional object of the invention is to provide a cover which is flexible and can be used to seal a trash container filled above capacity.

It is also another object of the invention to provide a cover which could be punctured to allow unusual objects to extend from the trash receptacle, but which would still provide some protection against precipitation.

The cover may also have indicia thereon with regard to a time of year, holiday, sports team, or the like.

Accordingly, an adjustable trash or garbage container cover is provided which is a flexible, water and odor-impermeable film having a central portion bounded by a peripheral edge. The peripheral edge contacts the side wall (s) of a trash or garbage container and includes an adhesive sealing member such as an adhesive having a release strip to permit the peripheral edge to be gathered about the side walls of the trash receptacle in order to seal the top opening against the intrusion of precipitation, emission of odors, and the like.

The invention also relates to a disposable, flexible, water and odor-impermeable bag which at the open or top edge thereof has an adhesive sealing member, generally the same or similar to the cover sealing member, which can be applied to a trash or garbage container as at the top external surface thereof to insure that the bag maintains its position or location upon the addition of trash to the container.

DETAILED DESCRIPTION OF THE INVENTION

Figure 1:
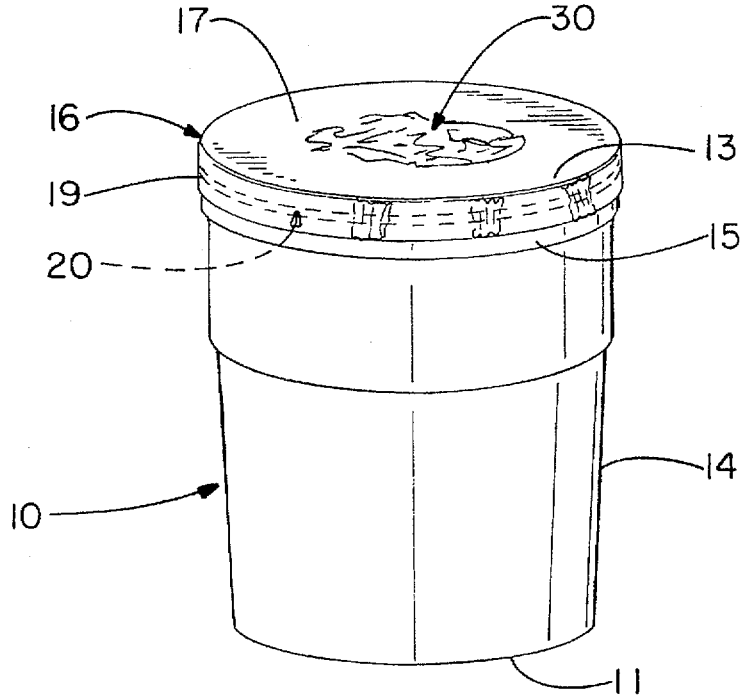
FIG. 1 is a perspective view of a trash container showing the cover sealingly attached thereto.

A trash container or garbage receptacle is shown generally at 10. The illustrated receptacle 10 is generally cylindrically shaped with a taper from bottom 11 to the round, circular opening or aperture 13. Since the container 10 has a circular cross-section, there is a singular side wall 14 having an enlarged, upper rim 15 which can include handles (not shown) and can also include a hinged lid (not shown). Of course, the invention may also be used with alternatively shaped trash containers, e.g., the rectangular bins often used for free-wheeling containers, or recycling bins.

The cover generally shown at 16 comprises a flexible, water and odor-impermeable film, having a central inner portion 17 and an outer peripheral edge or skirt 19. The cover is generally configured so that the diameter thereof is greater than the opening or aperture of the container such that the outer peripheral edge 19 overlaps upper rim 15 of exterior side wall 14 of the trash container 10 a sufficient distance to provide a skirt to enclose the container side wall(s). Typically, the cover diameter is from about 1.05 to about 2.5 or 3.0, and more preferably from about 1.1 or 1.25 to about 1.5 or 2.0 diameters of the container diameter. The inner portion 17 thus often covers the entire container aperture 13 and preferably allows for compensation of a slight to a large over-filled container 10. Should the container aperture opening not be circular but rectangular, etc., the shape of the cover is simply a proportional oversized shape of the aperture such that an excess exists, 1.05 to 2.5 or 3.0 times the particular aperture opening.

Figure 2:
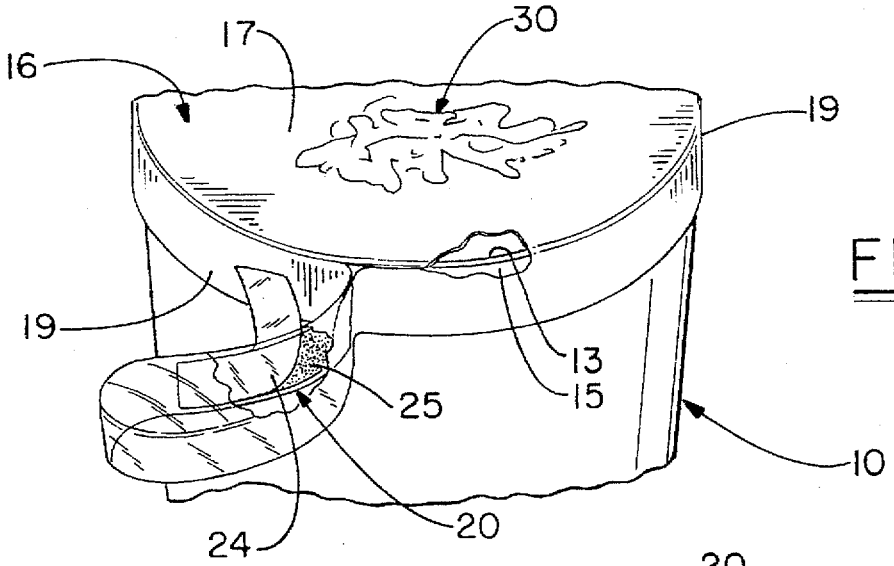
FIG. 2 is an enlarged, partial perspective view showing the cover being applied to the container or receptacle.
Figure 3:
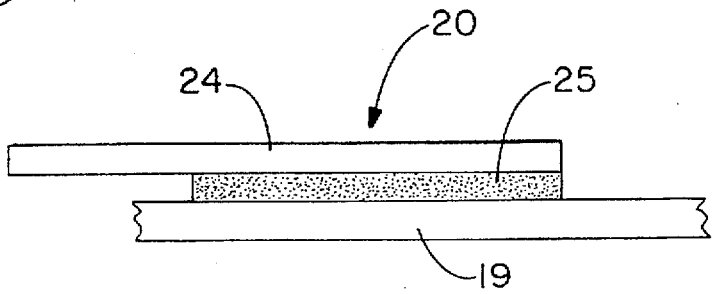
FIG. 3 is a side view showing an adhesive sealing member construction.

The outer peripheral edge or skirt 19 includes an adhesive sealing member 20. In an embodiment, FIG. 1, the adhesive sealing member 20 extends along the peripheral edge generally about the entire circumference thereof or, optionally, a substantial portion thereof. The adhesive member has pressure-sensitive adhesive thereon and a release strip or member thereover. Upon application of cover 16 to the trash container, the release strip can be removed and the peripheral edge applied to an entire circumference of aperture 13 of trash container side wall 14. Since the adhesive is pressure-sensitive, the cover can be quickly removed by prying the adhesive away from the container, adding additional trash to the container, etc., and reapplying the cover via adhesive 25. The pressure-sensitive adhesive is made of any conventional adhesive which can be releasably adhered to a substrate such as sidewall 14 of the trash container. In an alternative but preferred embodiment, as shown in FIGS. 2 and 3, sealing member 20 is located only along a short portion of the peripheral edge of the cover, i.e., less than 25, 20, 15, 10 or 5 percent thereof, e.g., a few to several inches. Preferably, the adhesive sealing member 20 includes a single bottom release member or strip 24 which optionally extends beyond adhesive 25 and which can be peeled away to expose the adhesive. Adhesive 25 can be any conventional releasable, pressure sensitive adhesive. Upon application of cover 16 to the receptacle, release member 24 is removed and the peripheral edge of the cover in the vicinity of the sealing member is gathered about or drawn taut about the exterior side of the container. The sealing member preferably containing pressure-sensitive adhesive 25 is then attached to the taut, peripheral edge. Since a releasable pressure-sensitive adhesive 25 is utilized, the releasable sealing portion can be removed, additional items or debris added to the container or removed therefrom, the cover reapplied, drawn taut to enclose the container, and releasably pressure sensitive adhesive 25 reapplied.

In either embodiment, the adhesive desirably has greater adherence to the edge or skirt 19, or can be permanently attached thereto, than to the cover portion or container to which it is to be releasably applied.

The cover 16 desirably includes reinforcement means about the outer peripheral edge 19. For example, the film may be doubled or folded back on itself, as through the use of melt-bonding, stitching, etc., such that the peripheral edge 19, exclusive of the sealing member portion, will curl over the trash container and hug the sidewall and form a closure.

The cover is preferably made of a material which is inexpensive, flexible, and impervious to water and odors. Also it is preferable that the cover has a sufficiently high tensile strength to withstand an accumulation of ice and snow, as well as withstand the stress of normal use. Suitable materials for the cover include plastic films and materials of from about 0.25 or 0.50 to about 10, 15, 20, or 25 mils, and preferably from about 0.5 or 0.75 to about 1.5, 3, or 5 mils. Preferred materials include flexible polymers such as polyethylene, polypropylene, polyvinyl chloride, and vinylidene chloride.

Optionally, the cover may include a scored or perforated area so that items which are taller than the trash container, such as boards or fluorescent light bulbs, can protrude from the container.

Optionally, the cover 16 of the present invention can also include any of numerous and various types of indicia 30 as for advertising purposes, holidays, etc., or for expressing the sentiment of the consumer. For example, the cover might include a jack-o-lantern, a Christmas tree, a "smiley face," or a sports logo.

The cover 16 of the present invention can also be sized and shaped so that it can be used to cover grills, outdoor furniture, or as a frost cover for plants, a cover for wood piles, and the like. Alternatively, the cover can be spread flat and loaded with leaves or lawn clippings and can be subsequently drawn into a bag and sealed using the adhesive strip 20.

Figure 4:
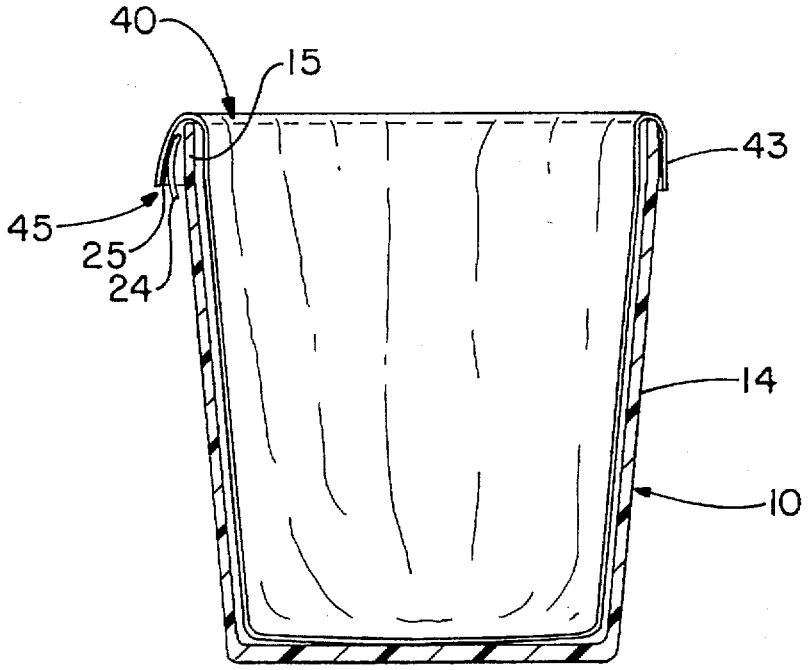
FIG. 4 is a side view in cross-section showing a flexible bag of the present invention attached through an adhesive sealing member to a trash receptacle.

The flexible, preferably water-proof, odor-impermeable film can also be in the form of a bag or sack for receiving and holding trash, garbage, etc., as in a trash container or the like. Referring to FIG. 4, bag 40 generally conforms to sidewall 14 of container 10 and has a sufficient length or height to extend above container upper rim 15. The bag extension length above the upper rim is a sufficient distance so that the bag can be folded over and about the rim. As with the cover, bag 40 has a peripheral edge 43 at the end thereof and has an adhesive sealing member 45 thereon. The adhesive sealing member can be similar if not the same as a sealing member shown in FIG. 3 for the cover. Thus, the substrate of the sealing member as shown in FIG. 3 can be the flexible bag 40 containing an adhesive, for example, 25 thereon. As with the cover, one side of the adhesive is more adherent than the remaining side which initially has a release strip or a member 24 thereon. Once the bag has been inserted into container 10, the top peripheral portion thereof is gathered, i.e., drawn taut, about the bag and releasable strip 24 removed therefrom. The adhesive sealing member is then applied in its taut, drawn manner to another portion of the bag so that a tight or constrictive fit or closure is made about the upper end of the trash receptacle. Thus, as the trash container is filled, the peripheral edge of the bag will not pulled over container rim portion 15. Alternatively, the releasable adhesive 25 can be applied directly to a portion of container rim 15. Although FIG. 4 only shows one adhesive sealing member of a finite length, multiple sealing members can exist around the peripheral edge of the bag such as at 2, 3, 4, or 5 locations, etc. Alternatively, the adhesive sealing member can be extend substantially about the entire bag peripheral edge so that upon utilization of the bag, it can be fastened to substantially the entire upper rim portion of the container.

The thickness of the bag can be the same as the cover, that is, from about 0.25 or 0.5 to about 10, 15, 20, or 25 mils, etc. The percent of the sealing member length extending along the peripheral edge of the bag can be small, i.e., as with the cover, generally less than 25, 20, 15, or 10 percent thereof. The bag can be disposable, and moreover can be utilized either alone or in association with cover 16.

While in accordance with the patent statutes the best mode and preferred embodiment has been set forth, the scope of the invention is not limited thereto, but rather by the scope of the attached claims.

What is claimed is:

1. A trash container having an exterior sidewall which define a top opening and an adjustable cover, comprising;

a plastic flexible film having a central portion bounded by a peripheral edge integral therewith and being configured such that said central portion is capable of fully covering said top opening and said peripheral edge is capable of contacting said sidewall, said integral peripheral edge on the bottom side thereof consisting of only a single pressure sensitive adhesive sealing member extending along less than 25 percent of said peripheral edge, said peripheral edge in the vicinity of said sealing member being drawn taut about said exterior sidewall of said container, and said adhesive sealing member being attached to said taut vicinity peripheral edge to seal the top opening of said container.

2. The trash container as set forth in claim 1, wherein said central portion has a top surface which includes indicia.

3. The trash container as set forth in claim 1, wherein said film is a plastic film having a thickness of from about 0.25 to about 25 mils.

4. The trash container as set forth in claim 3, wherein said plastic film comprises polyethylene, polypropylene, polyvinyl chloride.

5. The trash container as set forth in claim 4, wherein said central portion has a top surface which includes indicia.

6. The trash container as set forth in claim 4, wherein said adhesive sealing: member extends along less than 10 percent of said peripheral edge, and wherein said film thickness is from about 0.5 to about 3 mils.

7. An adjustable, disposable cover for a top opening of a trash receptacle having a sidewall which define the top opening, comprising;

a flexible, polyethylene, polypropylene, polyvinylidene chloride, or polyvinyl chloride film, having a thickness of from about 0.25 to about 25 mils, a central portion bounded by a peripheral edge integral therewith and including a top surface being; configured such that said central portion is capable of covering said top opening and said integral peripheral edge is capable of contacting said sidewall, the bottom of said integral peripheral edge consisting of only a single pressure sensitive adhesive member extending along less than 25 percent thereof, and said pressure sensitive adhesive member being adhered to an adjacent, taut integral, bottom peripheral edge portion.

8. The adjustable, disposable cover as in claim 7, wherein said adhesive extends along less than 10 percent of the length of said peripheral edge, and wherein said cover is at least 1.1 diameters of the top opening.

* * * * *